US006547352B1

(12) United States Patent
Ikeda

(10) Patent No.: US 6,547,352 B1
(45) Date of Patent: Apr. 15, 2003

(54) INK JET RECORDING DEVICE

(75) Inventor: Koji Ikeda, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/603,521

(22) Filed: Jun. 23, 2000

(30) Foreign Application Priority Data

Jun. 25, 1999 (JP) ..... 11-180434

(51) Int. Cl.[7] ..... B41J 29/38
(52) U.S. Cl. ..... 347/11; 347/15
(58) Field of Search ..... 347/15, 43, 100, 347/10, 11, 22

(56) References Cited

U.S. PATENT DOCUMENTS

| | | | | |
|---|---|---|---|---|
| 5,166,707 A | * | 11/1992 | Watanabe et al. | 347/22 |
| 5,745,140 A | | 4/1998 | Stoffel et al. | |
| 5,975,672 A | * | 11/1999 | Wen | 347/15 |
| 6,290,328 B1 | * | 9/2001 | Yamada et al. | 347/43 |
| 6,328,399 B1 | * | 12/2001 | Wen | 347/15 |
| 6,343,846 B1 | | 2/2002 | Asano | |

FOREIGN PATENT DOCUMENTS

| | | | |
|---|---|---|---|
| JP | 03016733 A | 1/1991 | 347/14 |
| JP | 05261941 A | 10/1993 | |
| JP | 7-125223 | 5/1995 | 347/23 |
| JP | 7-276615 | 10/1995 | 347/14 |
| JP | 8-174868 | 7/1996 | |
| JP | 9-164706 | 6/1997 | |
| JP | 10244692 A | 9/1998 | |
| JP | 11001647 | 1/1999 | |

OTHER PUBLICATIONS

Decision of Rejection mailed Aug. 20, 2002 for corresponding Japanese patent application.

* cited by examiner

*Primary Examiner*—Craig Hallacher
*Assistant Examiner*—Julian D. Huffman
(74) *Attorney, Agent, or Firm*—Harness, Dickey & Pierce, PLC

(57) ABSTRACT

Disclosed is an ink jet recording device. In order to produce images superior in characteristics such as water resistance and color reproducibility regardless of the type of recording paper 41 and in order to allow selection between a mode of high image-quality recording operation and a mode of high-speed recording operation, the ink jet recording device comprises an ink jet head having a first nozzle **2*i* for ejection of droplets of pigment ink containing a pigment as a coloring agent and a second nozzle 2*j*** for ejection of droplets of dye ink containing a dye as a coloring agent, wherein the maximum amount of ejection of a droplet of the dye ink that is fired from the second nozzle is set lower than the maximum amount of ejection of a droplet of the pigment ink that is fired from the first nozzle.

2 Claims, 11 Drawing Sheets

INK JET RECORDING DEVICE

BACKGROUND OF THE INVENTION

1. Field of the Invention

The present invention belongs to the technical field of ink jet recording devices comprising an ink jet head having a first nozzle for ejection of droplets of pigment ink and a second nozzle for ejection of droplets of dye ink.

2. Description of the Prior Art

Generally, pigment inks containing a pigment as a coloring agent exhibit excellent light resistance and water resistance with respect to plain paper (i.e., widely available commercial paper particularly for use by electrophotographic copying machines, which is, however, not manufactured with the intention of providing an optimum structure, composition, and characteristic suitable for ink jet recording devices) and special paper intended for use in ink jet recording (i.e., paper having an ink receiving layer on substrate). In spite of such properties, pigment inks, because of their relatively narrow color reproduction range, prove unsuitable for special paper requiring high level color reproducibility. Additionally, pigment inks, particularly color inks, exhibit extremely poor permeability, therefore proving unsuitable for permeable films (OHP sheets) either. On the other hand, dye inks containing a dye as a coloring agent, have a wider color reproduction range in comparison with pigment inks but are unsuitable for plain paper because of being poor in light resistance as well as in water resistance with respect to plain paper.

With a view to producing excellent images regardless of the type of recording paper, Japanese Unexamined Patent Gazette No. H11-1647 proposes a technique in which both dye ink and pigment ink are prepared. Whereas droplets of the dye ink are for effecting recording on special paper, recording on plain paper is effected by laying droplets of the dye and pigment inks one on top of the other.

Such proposal, however, remains open to further improvement. In other words, the foregoing arrangement of merely preparing both dye ink and pigment ink for changing ink to be ejected by the type of recording paper fails to provide any sufficient counterbalancing advantage to the increase in ink jet head cost.

Bearing in mind the above-described drawback with the prior art technique, the present invention was made by moving forward with the arrangement in which both dye ink and pigment ink are prepared. Accordingly, an object of the present invention is to produce images superior in characteristics such as water resistance and color reproducibility for any type of recording paper, and to improve cost-performance by permitting selection between a mode of high image-quality recording operation and a mode of fast recording operation.

SUMMARY OF THE INVENTION

In order to achieve the object, in the present invention, either the maximum amount of ejection of a droplet of dye ink that is ejected from a second nozzle is set lower than the maximum amount of ejection of a droplet of pigment ink that is ejected from a first nozzle, or the density of a droplet of dye ink that is ejected from a second nozzle onto recording paper is set lower than the density of a droplet of pigment ink that is ejected from a first nozzle onto recording paper.

The present invention provides a first ink jet recording device comprising an ink jet head having a first nozzle for ejection of droplets of pigment ink containing a pigment as a coloring agent and a second nozzle for ejection of droplets of dye ink containing a dye as a coloring agent so that recording is effected by ejection of ink droplets from at least either the first or second nozzle of the ink jet head onto recording paper, wherein the maximum amount of ejection of a droplet of the dye ink that is ejected from the second nozzle is set lower than the maximum amount of ejection of a droplet of the pigment ink that is ejected from the first nozzle.

In accordance with the above-described construction, for the case of the dye ink, a plurality of ink droplets whose ejection amount is set smaller are laid one on top of the other to effect recording, thereby freely producing dots of small diameter and dots of large diameter for the achievement of high image-quality recording. For the case of the pigment inks, since the amount of ejection is large, high-speed recording can be effected, although image quality drops somewhat. Generally, whereas high image-quality is required for recording on special paper, high-speed recording is required for recording on plain paper. Accordingly, such arrangement that recording on special paper is effected by dye ink droplets while on the other hand recording on plain paper is effected by pigment ink droplets will not only produce images superior in characteristics such as water resistance and color reproducibility on both types of paper but also meet the foregoing requirements. Further, if recording on a transparent film is effected by dye ink droplets, this eliminates the problem of permeability. Accordingly, it is possible to change a type of ink that is ejected and, in addition, it is possible to permit selection between a mode of high image-quality recording operation and a mode of high-speed recording operation, therefore providing improvements in cost-performance.

It is preferred that the diameter size of the second nozzle be set smaller than that of the first nozzle in the first ink jet recording device.

Because of such arrangement, the amount of ejection of dye ink droplets (the maximum ejection amount) can be further decreased, while on the other hand the amount of ejection of pigment ink droplets (the maximum ejection amount) can be further increased. In the case the first nozzle is identical in diameter size with the second nozzle, although it is possible to change ejection amounts by making pulse waveforms, which are applied to actuators operative to cause ejection of each ink droplet, different from each other, there are limits of setting a great difference in ejection amount between dye and pigment ink droplets. In the present invention, however, the diameter size of the second nozzle is set smaller than that of the first nozzle, which facilitates allowing these nozzles to eject their respective ink droplets at different ejection amounts. In addition, the difference can be expanded considerably.

Preferably, the first nozzle is formed in a first nozzle formation member disposed on a portion of a surface of the ink jet head and the second nozzle, which is smaller in diameter size than the first nozzle, is formed in a second nozzle formation member disposed, in juxtaposition with the first nozzle formation member, on the ink jet head surface portion, in the first ink jet recording device.

As a result of such arrangement, pigment ink liable to cause clogging does not easily adhere to the surface of the second nozzle formation member, therefore controlling clogging of the second nozzle of small diameter by pigment ink.

Preferably, the first ink jet recording device is provided with a first blade for wiping off pigment ink adhered on a surface of the first nozzle formation member and a second blade for wiping off dye ink adhered on a surface of the second nozzle formation member. This arrangement definitely ensures that clogging of the second nozzle by pigment ink can be controlled.

The present invention provides a second ink jet recording device comprising an ink jet head having a first nozzle for ejection of droplets of pigment ink containing a pigment as a coloring agent and a second nozzle for ejection of droplets of dye ink containing a dye as a coloring agent so that recording is effected by ejection of ink droplets from at least either the first or second nozzle of the ink jet head onto recording paper, wherein the density of a droplet of the dye ink that is ejected from the second nozzle onto the recording paper is set lower than the density of a droplet of the pigment ink that is ejected from the first nozzle onto the recording paper.

In accordance with such arrangement, the dye ink density is set lower. A plurality of ink droplets of the dye ink are laid one on top of the other to effect recording, thereby producing in a free manner dots of low density and dots of high density for the achievement of high image-quality recording. On the other hand, although the pigment ink is able to produce only dots of high density, there is no need for laying a plurality of pigment ink droplets one on top of the other. This allows pigment inks to achieve high-speed recording. As a result, like the first ink jet recording device, such arrangement that recording on special paper is effected by dye ink droplets while on the other hand recording on plain paper is effected by pigment ink droplets will not only produce images superior in characteristics such as water resistance and color reproducibility on both types of paper but also effect high image-quality recording on special paper and high-speed recording on plain paper.

In each of the first and second ink jet recording devices, it is preferred that the ink jet head further has a first actuator for causing, when a first drive pulse is applied thereto, ejection of a droplet of the pigment ink from the first nozzle and a second actuator for causing, when a second drive pulse is applied thereto, ejection of a droplet of the dye ink from the second nozzle, and that the ink jet recording device further comprises drive signal generation means for generating a drive signal in which the first and second drive pulses repeatedly occur and drive pulse selection/application means for selecting between the first drive pulse and the second drive pulse from the drive signal generated by the drive signal generation means so that, when the first drive pulse is selected, the selection (i.e., the first drive pulse) is applied to the first actuator, while, when the second drive pulse is selected, the selection (i.e., the second drive pulse) is applied to the second actuator.

This accordingly eliminates the need for individually generating a first and a second drive pulse. Generation of a single drive signal including first and second drive pulses therefore suffices. This cuts down the cost of drive circuits for the first and second actuators.

It is preferred that the drive signal generation means is so constructed as to generate a drive signal which repeats a pulse occurrence operation in which, after a succession of occurrences of a plurality of second drive pulses, a less number of first drive pulses than the number of the successively-occurred first drive pulses occur.

Such arrangement, since recording pixel density is generally made higher when recording is effected by dye ink droplets in comparison with when recording is effected by pigment ink droplets, makes it possible to set the numbers of first and second drive pulses according to the recording pixel density difference, whereby optimum drive signals can be obtained.

When a drive signal is generated which repeats a pulse occurrence operation in which, after a succession of occurrences of a plurality of second drive pulses, a less number of first drive pulses than the number of the successively-occurred first drive pulses occur, it is preferred that the drive signal generation means is so constructed as to generate a drive signal in which a second drive pulse occurs at fixed intervals.

Because of such arrangement, when ink droplets are ejected onto recording paper while the ink jet head is moved with respect to the recording paper at an approximately fixed speed, dye ink droplets fired from the second nozzle land on the recording paper to be spaced at equal intervals, thereby coping with high image-quality.

PREFERRED EMBODIMENT OF THE INVENTION

An embodiment of the present invention will be described below with reference to the accompanying drawing figures.

Figure 1:
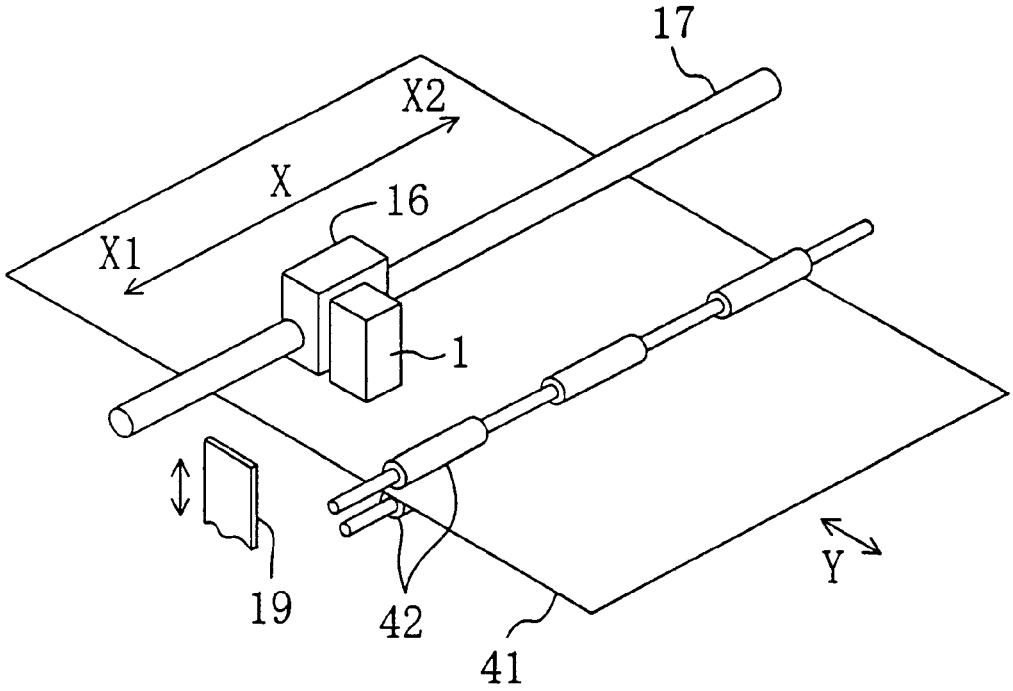
FIG. 1 is a schematic perspective view illustrating an ink jet recording device according to an embodiment of the present invention.

Referring first to FIG. 1, there is shown an ink jet recording device according to an embodiment of the present invention. The ink jet recording device is provided with an ink jet head 1 for ejection of droplets of ink onto a sheet of recording paper 41 as will be described later. The ink jet head 1 is fixedly supported on a carriage 16. Mounted in the carriage 16 is a carriage motor 28 (see FIG. 7) which is not shown in FIG. 1. Being guided by a carriage shaft 17 extending in a primary scanning direction (i.e., the X direction shown in FIGS. 1, 2, and 6), the ink jet head 1 and the carriage 16 are reciprocated by the carriage motor 28 in the primary scanning direction.

The recording paper sheet 41 is placed between two conveying rollers 42 which are rotatably driven by a conveying motor 26 (see FIG. 7) which is not shown in FIG. 1. The recording paper sheet 41 is conveyed in a secondary scanning direction perpendicular to the primary scanning direction (i.e., the Y direction shown in FIGS. 1, 2, and 6) by the conveying motor 26 and each conveying roller 42.

As shown in FIGS. 2–5, the ink jet head 1 has a plurality of pressure chambers 4 for holding an ink, a plurality of nozzles 2 in communication with each pressure chamber 4 respectively, and a plurality of piezoelectric actuators 10 for application of a voltage to the pressure chambers 4 to cause ejection of ink droplets from the nozzles 2. Each piezoelectric actuator 10, which is a device employing a piezoelectric element 13 that undergoes deformation by the piezoelectric effect, causes its corresponding pressure chamber 4 to shrink and expand. This accompanies a change in the pressure of the pressure chamber 4, by which pressure change an ink droplet is ejected from the nozzle 2 or the pressure chamber 4 is filled with ink.

Figure 2:
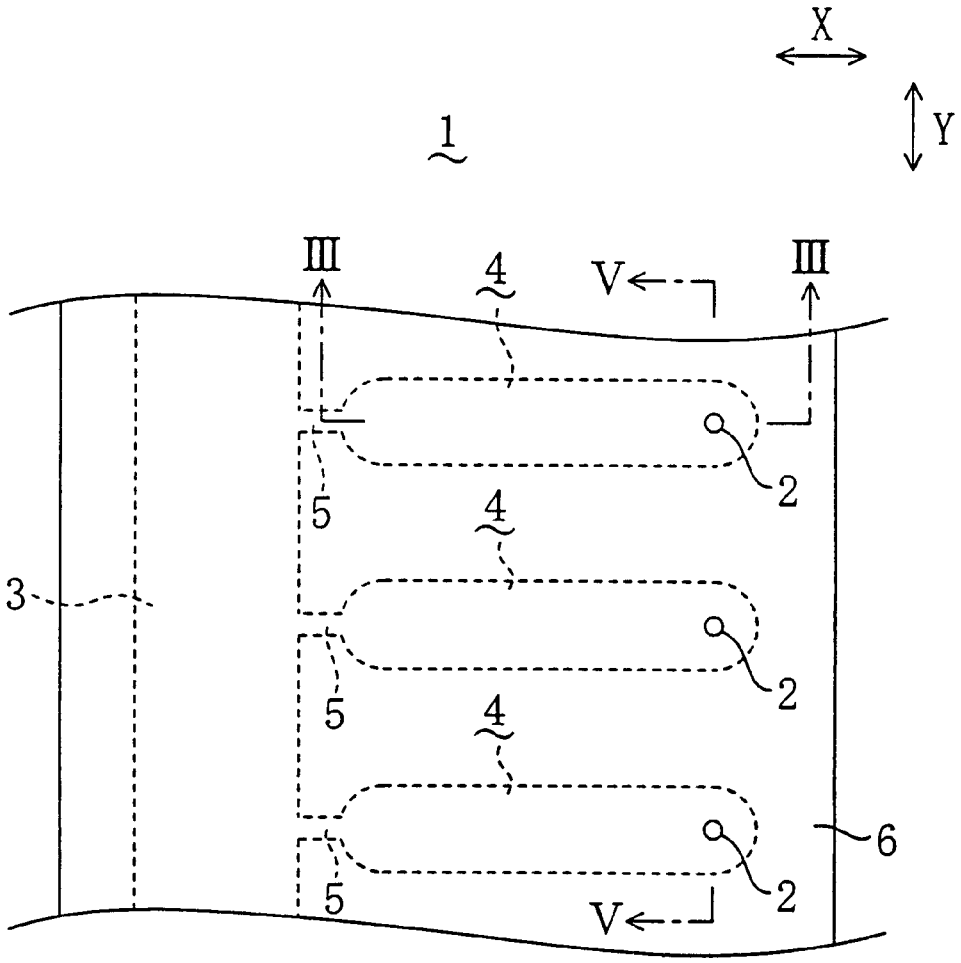
FIG. 2 is a partial bottom view of an ink jet head of the ink jet recording device.

As shown in FIG. 2, the pressure chambers 4 each are formed into a long groove-like shape extending in the primary scanning direction in the ink jet head 1, lying in the secondary scanning direction at specified intervals from each other. The nozzles 2 are formed in one ends (ends on the right-hand side in FIG. 2) of the pressure chambers 4 in such a manner that they open at the bottom of the ink jet head 1 at specified intervals from each other in the secondary scanning direction.

The other ends of the pressure chambers 4 (on the left-hand side in FIG. 2) are connected, through ink supply openings 8 (see FIG. 3), to one ends of ink supply passages 5 respectively. The other ends of the ink supply passages 5 each are connected to an ink supply chamber 3 which is so formed as to extend in the secondary scanning direction.

Figure 3:
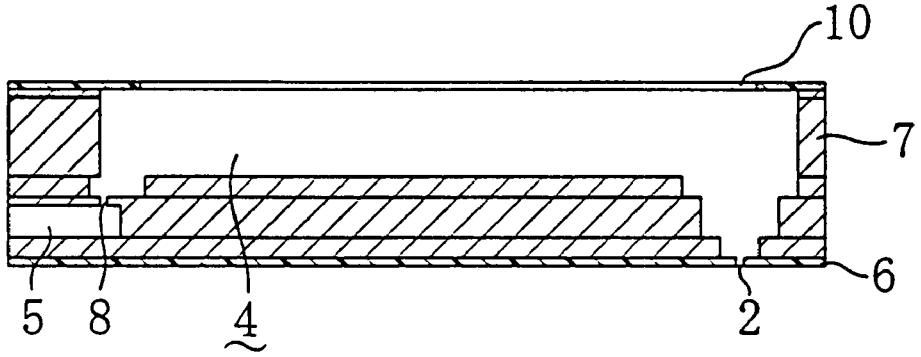
FIG. 3 is a cross-sectional view taken along line III—III of FIG. 2.

Further, as shown in FIG. 3, the ink jet head 1 is constructed by sequential lamination of a nozzle plate 6 disposed at a bottom portion (a surface portion) of the ink jet head 1 and serving as a nozzle formation member through which the nozzle 2 is formed, a compartmenting wall 7 which compartments and forms the pressure chamber 4 and the ink supply passage 5, and the piezoelectric actuator 10. The nozzle plate 6 is formed of a polyimide plate having a thickness of 20 $\mu$m. The compartmenting wall 7 is formed of a laminated plate of stainless steel having a thickness of 280 $\mu$m.

Figure 4:
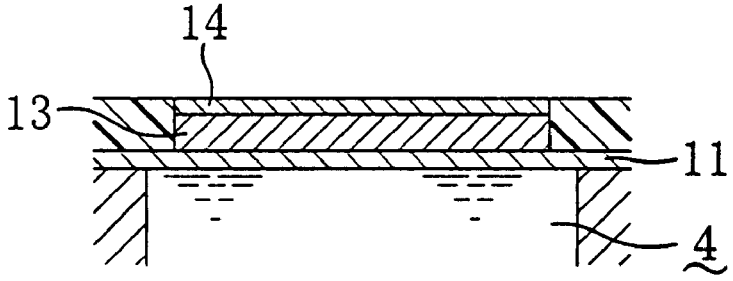
FIG. 4 is a partial sectional-cross view of a vicinity of a piezoelectric actuator of the ink jet head.
Figure 5:
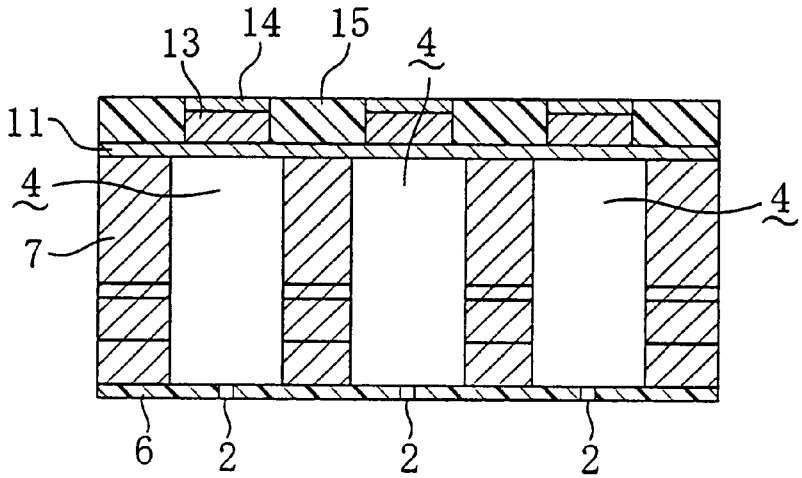
FIG. 5 is a cross-sectional view taken along line V—V of FIG. 2.

As exaggeratedly shown in FIGS. 4 and 5, the piezoelectric actuator 10 is constructed by sequential lamination of an oscillation plate 11 so provided as to face the pressure chamber 4, the piezoelectric element 13 operative to oscillate the oscillation plate 11, and an individual electrode 14. The oscillation plate 11 is formed of a plate of chromium having a thickness of 2 $\mu$m and functions also as a common electrode for applying, together with the individual electrode 14, a voltage (a drive pulse which will be described later) to each piezoelectric element 13 respectively. The piezoelectric elements 13 are provided to each pressure chamber 4 respectively. The piezoelectric element 13 is of an extremely thin type, being formed of a layer of PZT (lead zirconate titanate) having a thickness of 3 $\mu$m. The individual electrode 14 is formed of a plate of platinum having a thickness of 0.1 $\mu$m. The total thickness of the piezoelectric actuator 10 is about 5 $\mu$m. An insulating material 15 of polyimide is filled between each two adjacent piezoelectric elements 13 (individual electrodes 14).

Figure 6:
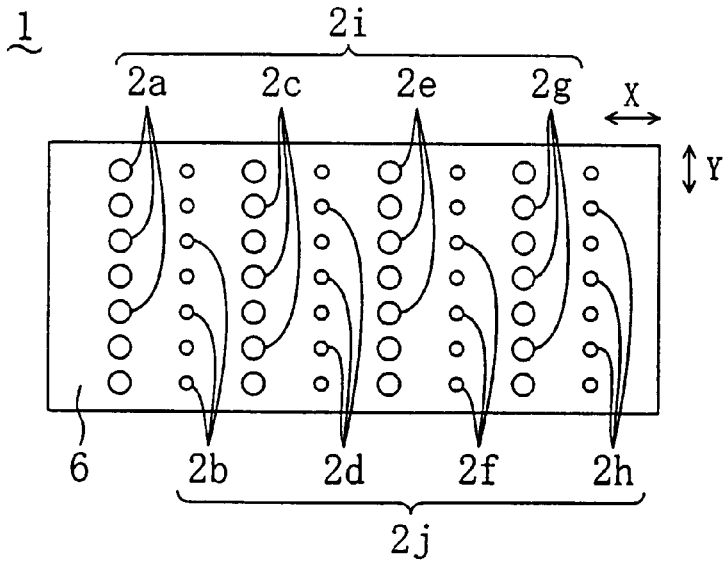
FIG. 6 is a schematic bottom view of the entire ink jet head.

The ink jet head 1 is so constructed as to eject four kinds of colors (black, cyan, magenta, and yellow). Further, the ink jet head 1 ejects not only a droplet of pigment ink containing a pigment as a coloring agent but also a droplet of dye ink containing a dye as a coloring agent for each color. In other words, as shown in FIG. 6, the nozzles 2 include black pigment nozzles 2*a* for ejection of black pigment ink droplets, black dye nozzles 2*b* for ejection of black dye ink droplets, cyan pigment nozzles 2*c* for ejection of cyan pigment ink droplets, cyan dye nozzles 2*d* for ejection of cyan dye ink droplets, magenta pigment nozzles 2*e* for ejection of magenta pigment ink droplets, magenta dye nozzles 2*f* for ejection of magenta dye ink droplets, yellow pigment nozzles 2*g* for ejection of yellow pigment ink droplets, and yellow dye nozzles 2*h* for ejection of yellow dye ink droplets. The pigment nozzles 2*a*, 2*c*, 2*e*, and 2*g* of the respective colors (hereinafter referred to as the first nozzles 2*i*) and the dye nozzles 2*b*, 2*d*, 2*f*, and 2*h* of the respective colors (hereinafter referred to as the second nozzles 2*j*) are arranged on respective lines extending in the secondary scanning direction and running parallel with one another. In FIG. 2, only a portion of either the first nozzles 2*i* or the second nozzles 2*j* of any one of the foregoing four colors is illustrated. The diameter size of the second nozzles 2*j* is set smaller than that of the first nozzles 2*i*.

As shown in FIG. 1, the present recording device is provided with a blade 19 for wiping off ink adhered to the bottom (surface) of the nozzle plate 6. On a lateral side of the recording paper sheet 41, the blade 19 is vertically movably supported on a device main body member (not shown in the figure). During non-recording operation, with the blade 19 moved upward, the ink jet head 1 is so traversed as to overlie the blade 19. As a result, the blade 19 rubs the bottom of the nozzle plate 6 for wiping off ink adhered to the nozzle plate bottom.

Figure 7:
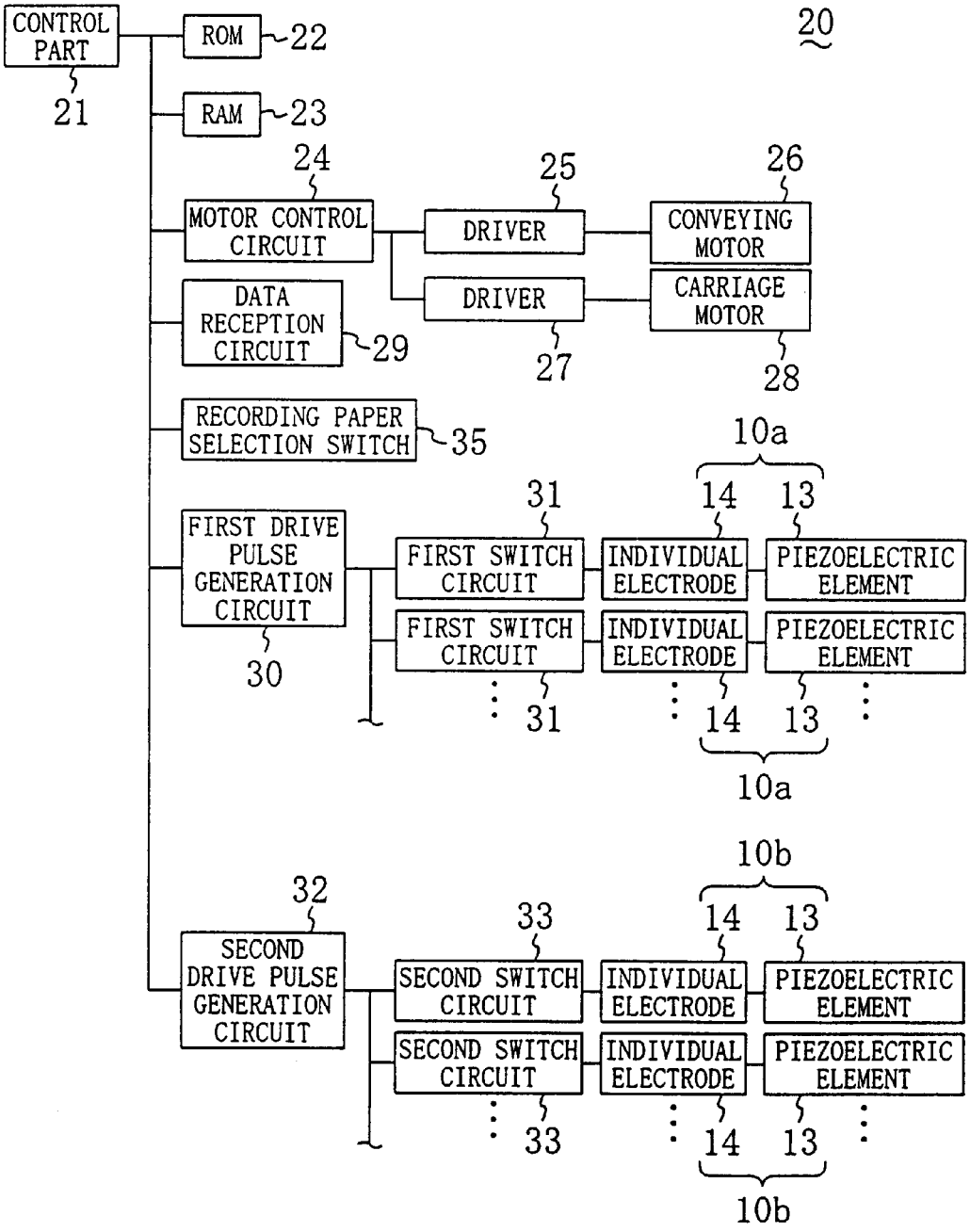
FIG. 7 is a block diagram illustrating a structure of a drive device of the ink jet recording device.

Referring next to a block diagram shown in FIG. 7, the structure of a drive device 20 of the ink jet recording device will be described. The drive device 20 comprises a control part 21 formed of a CPU, a ROM 22 for the storage of routines for various data processing, a RAM 23 for the storage of various data, driver circuits 25 and 27 and a motor control circuit 24 for the control of the conveying motor 26 and the carriage motor 28, a data reception circuit 29 for receiving recording data, first and second drive signal generation circuits 30 and 32, and a recording paper selection switch 35.

Figure 8:
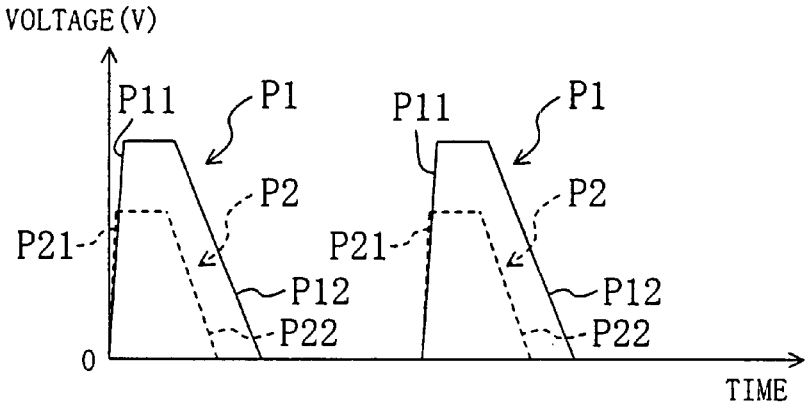
FIG. 8 is a waveform diagram depicting a first drive pulse and a second drive pulse.

The first drive pulse generation circuit 30 is implemented by a circuit for generating a first drive pulse P1 (indicated by a solid line in FIG. 8) at specified intervals. The first drive pulse generation circuit 30 is connected to the individual electrodes 14 of the piezoelectric actuators 10 (which are called first piezoelectric actuators 10*a*) for the first nozzles 2*i* of the ink jet head 1, through first switch circuits 31 disposed for each first piezoelectric actuator 10*a*.

The first switch circuits 31 are connected to the individual electrodes 14 of the first piezoelectric actuators 10*a* respectively. The first switch circuits 31 each have a circuit capable of switching between ON and OFF of a transistor. When the ink jet head 1 is traveling in the primary scanning direction, the first switch circuits 31 selectively provide to their respective first piezoelectric actuators 10*a* the first drive pulse P1 generated by the first drive pulse generation circuit 30.

The first drive pulse P1 has a trapezoidal shape comprising a rise waveform P11 which deforms the first piezoelectric actuator 10*a* in such a way as to cause the pressure chamber 4 to shrink and a fall waveform P12 which is set smaller in the degree of voltage variation with respect to time than the rise waveform P11 and which deforms the first piezoelectric actuator 10*a* in such a way as to cause the pressure chamber 4 to expand, wherein the rise waveform P11 is first input into the first piezoelectric actuator 10*a* thereby to cause ejection of a pigment ink droplet from the first nozzle 2*i*. This is followed by input of the fall waveform P12 into the first piezoelectric actuator 10*a* thereby to fill the pressure chamber 4 with pigment ink.

On the other hand, the second drive signal generation circuit 32 is implemented by a circuit for generating a second drive pulse P2 (indicated by a broken line in FIG. 8) at the same cycle that the first drive pulse P1 is generated. The second drive pulse generation circuit 32 is connected to the individual electrodes 14 of the piezoelectric actuators 10 (which are called second piezoelectric actuators 10*b*) for the second nozzles 2*j*, through second switch circuits 33 disposed for each second piezoelectric actuator 10*b*. The second switch circuit 33 is the same as the first switch circuit 31. When the ink jet head 1 is traveling in the primary scanning direction, the second switch circuits 33 selectively provide to their respective second piezoelectric actuators 10*b* the second drive pulse P2 generated by the second drive pulse generation circuit 32.

Like the first drive pulse P1, the second drive pulse P2 also has a trapezoidal shape comprising a rise waveform P21 which deforms the second piezoelectric actuator 10*b* in such a way as to cause the pressure chamber 4 to shrink and a fall waveform P22 which is set smaller in the degree of voltage variation with respect to time than the rise waveform P21 and which deforms the second piezoelectric actuator 10*b* in such a way as to cause the pressure chamber 4 to expand, wherein the rise waveform P21 is first input into the second piezoelectric actuator 10*b* thereby to cause ejection of a dye ink droplet from the second nozzle 2*j*. This is followed by input of the fall waveform P22 into the second piezoelectric actuator 10*b* thereby to fill the pressure chamber 4 with dye ink.

The maximum voltage of the second drive pulse P2 is set lower than that of the first drive pulse P1. As a result of such setting, even when the first and second nozzles 2*i* and 2*j* have the same diameter size, the amount of ejection of a dye ink droplet that is fired from the second nozzle 2*j* (which is equivalent to the maximum ejection amount because there is only one kind of ejection amount in the present embodiment) is set lower than the amount of ejection of a pigment ink droplet that is fired from the first nozzle 2*i* (which is likewise equivalent to the maximum ejection amount). As described hereinbefore, the diameter size of the second nozzle 2*j* is actually set smaller than that of the first nozzle 2*i*, as a result of which setting the difference between these two ejection amounts is considerably great in comparison with when they have the same diameter. In other words, if the first and second nozzles have the same diameter, this will limit the ejection amount ratio of pigment ink droplet to dye ink droplet to about 2:1. However, the ejection amount ratio can be set at about 4:1 when the first and second nozzles have different diameters. For instance, when the first nozzle 2*i* has a diameter of about 22 $\mu$m and the second nozzle 2*j* has a diameter of about 14 $\mu$m, the first nozzle 2*i* emits a pigment ink droplet at an amount of about 16 pl, whereas the second nozzle 2*j* emits a dye ink droplet at an amount of about 4 pl. Further, the diameter of the ink supply opening 8 between the pressure chamber 4 and the ink supply passage 5 is set according to the diameter of its corresponding nozzle, in other words, the diameter of each ink supply opening 8 corresponding to the second nozzle 2*j* is set smaller than the diameter of each ink supply opening 8 corresponding to the first nozzle 2*i*.

The recording paper selection switch 35 is a switch switchable by the user according to the type of the recording paper sheet 41, thereby allowing the user to switch between three types of paper including PLAIN PAPER, SPECIAL PAPER, and TRANSPARENT FILM. When the control part 21 determines that PLAIN PAPER is being selected by the recording paper selection switch 35, only pigment ink droplets are ejected from the first nozzles 2*i* and no dye ink droplets are ejected at all from the second nozzles 2*j*. On the other hand, when the control part 21 determines that either SPECIAL PAPER or TRANSPARENT FILM is being selected by the recording paper selection switch 35, only dye ink droplets are ejected from the nozzles 2*j* and no pigment ink droplets are ejected at all from the first nozzles 2*i*.

The operation of the ink jet recording device constructed as above will be described. In the first place, when the control part 21 determines that the recording paper selection switch 35 is selecting either SPECIAL PAPER or TRANSPARENT FILM, the recording paper sheet 41 is conveyed to a desired position by the conveying motor 26 and the conveying rollers 42. Thereafter, the ink jet head 1 is traversed, together with the carriage 16, by the carriage motor 28 from one end (position X1) to the other end (position X2) at an approximately constant speed along the primary scanning direction, and, at the same time, based on image data received by the data reception circuit 29, the ON/OFF switch control of the second switch circuit 33 is performed to cause ejection of dye ink droplets from each of the second nozzles 2*j* to target spots. At this time, the first switch circuit 31 remains in the OFF state, and no pigment ink droplets are ejected from the first nozzles 2*i*. Then, the ink jet head 1 is brought back again to the position X1 from the position X2. Thereafter, the ink jet head 1 is made again to travel from the position X1 to the position X2 at an approximately constant speed so that dye ink droplets are ejected to spots requiring an increase in dot diameter by dye ink droplet superimposition. In this way, a recording image for one scan of the ink jet head 1 is recorded on the recording paper sheet 41. This is followed by returning of the ink jet head 1 from the position X2 to the position X1 and, at the same time, the recording paper sheet 41 is conveyed by the conveying motor 26 and the conveying rollers 42 by a specified amount of conveyance. Then, the ink jet head 1 is again moved from the position X1 to the position X2 and, at the same time, each of the second nozzles 2*j* ejects a respective dye ink droplet. Because of this, a recording image for another one scan is recorded on the recording paper sheet 41. By repeatedly carrying out such an operation, it is possible to form a desired image all over the recording paper sheet 41 by dye ink droplets. Further, at the time of causing the ink jet head 1 to return to the position X1 from the position X2, an arrangement may be made in which superimposition of dye ink droplets or recording for another new one scan can be performed.

On the other hand, when the control part 21 determines that the recording paper selection switch 35 is selecting PLAIN PAPER, the ink jet head 1 is traversed, together with the carriage 16, by the carriage motor 28 along the primary scanning direction from the position X1 to the position X2 at an approximately constant speed, and, at the same time, based on image data received by the data reception circuit 29, the ON/OFF switching control of the first switch circuit 31 is carried out to cause ejection of pigment ink droplets from each of the first nozzles 2*i* to target spots. At this time, the second switch circuit 33 remains in the OFF state so that no dye ink droplets are ejected from the second nozzles 2*j*. As a result, the target image is formed all over the recording paper sheet 41 by pigment ink droplets.

Accordingly, in the present invention, when the recording paper sheet 41 is a sheet of plain paper, PLAIN PAPER is selected by the recording paper selection switch 35 for ejection of pigment ink droplets to effect recording. This produces images superior in light resistance as well as in water resistance. In addition, such a pigment ink droplet ejection amount is relatively large, thereby making it possible to achieve high-speed recording. On the other hand, when the recording paper sheet 41 is a sheet of special paper, SPECIAL PAPER is selected by the recording paper selection switch 35 for ejection of dye ink droplets to effect recording. This realizes high level color reproducibility required when using special paper. In addition, such a dye ink droplet ejection amount is relatively small so that recording by laying a plurality of dye ink droplets one on top of the other produces in a free manner dots of small diameter and dots of large diameter, thereby achieving high image-quality recording. Further, when the recording paper sheet 41 is a transparent film, TRANSPARENT FILM is selected by the recording paper selection switch 35 for ejection of dye ink droplets to effect recording. This prevents the problem of permeability from arising. It is therefore possible to provide improvements in cost performance by preparing both pigment ink and dye ink for making a change in the type of ink according to the type of the recording paper sheet 41 and by selecting between a mode of high image-quality recording operation and a mode of high-speed recording operation.

In the present embodiment, the first drive pulse P1 and the second drive pulse P2 differ from each other in waveform and, in addition, the first nozzle 2*i* and the second nozzle 2*j* differ from each other in diameter size. Alternatively, an arrangement may be made in which either only the diameters of the first and second nozzles 2*i* and 2*j* are the same, or only the waveforms of the first and second drive pulses P1 and P2 are the same. In other words, any other similar arrangements may be made as long as dye ink droplets are ejected at smaller amounts than pigment ink droplet.

Further, an arrangement may be made in which plural types of pigment ink droplets are ejected from the first nozzles 2*i* at different ejection amounts (plural types of the first drive pulses P1 are generated). Likewise, another arrangement may be made in which plural types of dye ink droplets are ejected from the second nozzles 2*j* at different ejection amounts (plural types of the second drive pulses P2 are generated). For the case of ejection of plural types of ink droplets, such an arrangement that the maximum amount of ejection of a dye ink droplet that is ejected from the second nozzle 2*j* is set lower than the maximum amount of ejection of a pigment ink droplet that is ejected from the first nozzle 2*i* will suffice, and a pigment ink droplet ejection amount at the minimum side may fall below a dye ink droplet ejection amount at the maximum side. As a result, if recording is effected by pigment ink droplets fired at an ejection amount at the minimum side, this will effect high image-quality recording, even with pigment ink.

Figure 9:
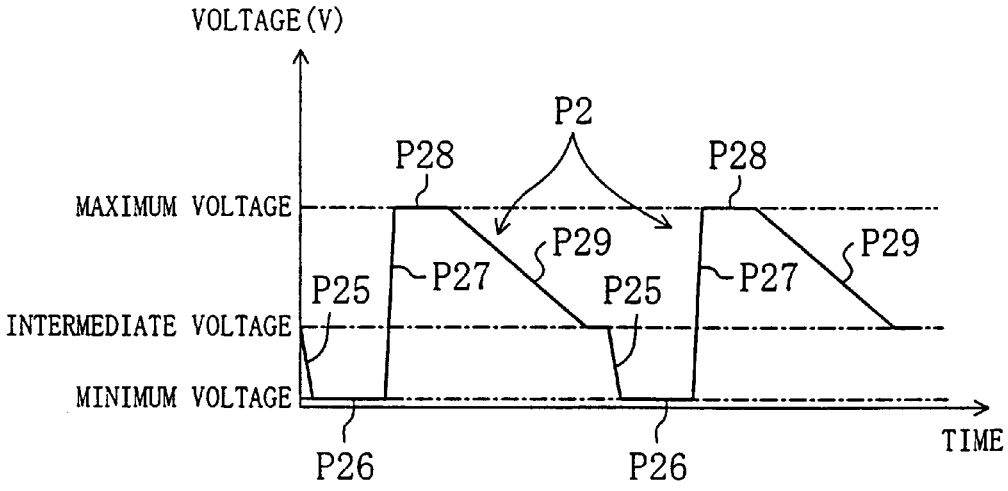
FIG. 9 is a waveform diagram depicting a variation of the second drive pulse.
Figure 10:
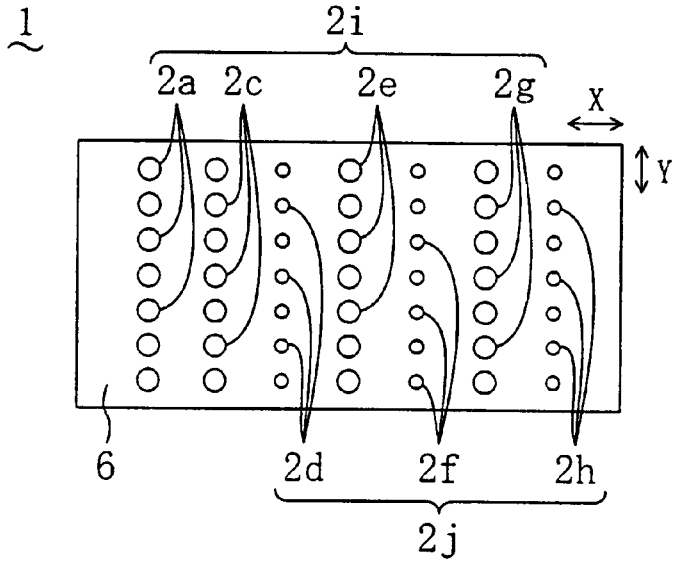
FIG. 10 is a corresponding diagram to FIG. 6 without the provision of black dye nozzles.

Further, with the first drive pulse P1 remaining unchanged in waveform, the second drive pulse P2 may be formed to a so-called pull-push-pull waveform, as shown in FIG. 9. In other words, the second drive pulse P2 may have in succession a first fall waveform P25 which descends from an intermediate voltage between a minimum voltage and a maximum voltage down to that minimum voltage, a minimum voltage maintenance waveform P26 which retains the minimum voltage, a rise waveform P27 which ascends from the minimum voltage up to the maximum voltage, a maximum voltage maintenance waveform P28 which retains the maximum voltage, and a second fall waveform P29 which is set lower in the degree of voltage variation with respect to time than the first fall waveform P25 and the rise waveform P27 and which returns from the maximum voltage to the intermediate voltage. This reduces the amount of ejection of a dye ink droplet that is fired from the second nozzle 2*j* to a further extent. For example, if the second nozzle 2*j* has a diameter of about 14 $\mu$m as in the foregoing embodiment, the ejection amount thereof can be set to about 2 pl. The ejection amount ratio of pigment ink droplet to dye ink droplet can be set to about 8:1. On the other hand, when a dye ink droplet ejection amount of about 4 pl is sufficient, the diameter size of the second nozzle 2*j* can be increased up to about 18 $\mu$m.

In the foregoing embodiment, both the first and second nozzles 2*i* and 2*j* are prepared for each of the colors (black, cyan, magenta, and yellow). For the case of the color of black, however, it may be arranged such that only the first nozzles 2*i* (the black pigment nozzles 2*a*) are provided. In this case, with regard to the color of black, pigment ink droplets are ejected even when the recording paper sheet 41 is special paper or transparent film. However, the problem of color reproducibility and permeability is not so serious as the other colors of cyan, magenta, and yellow. Besides, pigment ink droplets coheres or thickens by contact with dye ink droplets, thereby controlling the running of the dye ink droplets. In addition, the provision of the first and second nozzles 2*i* and 2*j* may be made for at least one of the ink colors.

Furthermore, when the recording paper sheet 41 is plain paper, in addition to ejection of pigment ink droplets, dye ink droplets of any one of the colors may be subordinately ejected. On the other hand, when the recording paper sheet 41 is a sheet of special paper or a transparent film, in addition to ejection of dye ink droplets, pigment ink droplets of any one of the colors may be subordinately ejected.

Figure 11:
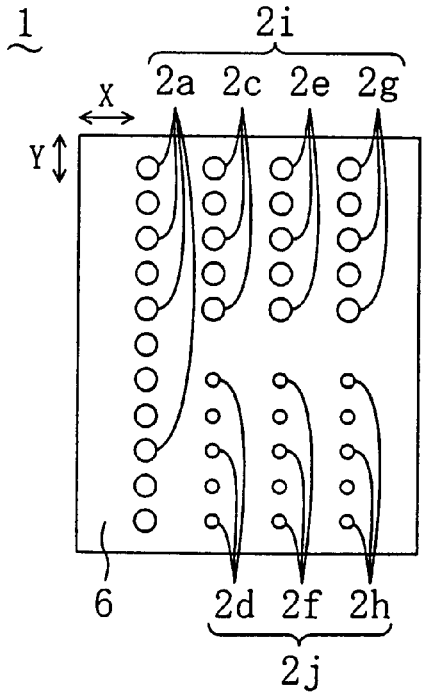
FIG. 11 is a corresponding diagram to FIG. 6 showing a variation of the placement of first and second nozzles.

Moreover, the first and second nozzles 2*i* and 2*j* can be freely arranged. For example, as FIG. 11 shows, the first and second nozzles 2*i* and 2*j* are arranged, by color, on the same line extending in the secondary scanning direction (in FIG. 11, only the first nozzles 2*i* are provided with respect to the color of black).

Figure 12:
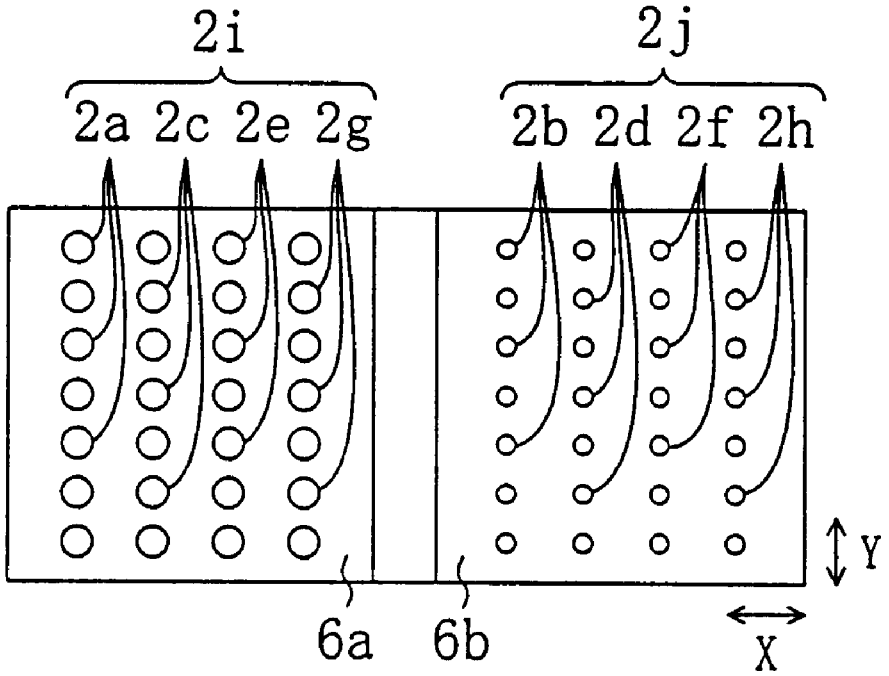
FIG. 12 is a corresponding diagram to FIG. 6 showing an arrangement in which first and second nozzle plates are mounted on the ink jet head bottom in juxtaposition with each other.
Figure 13:
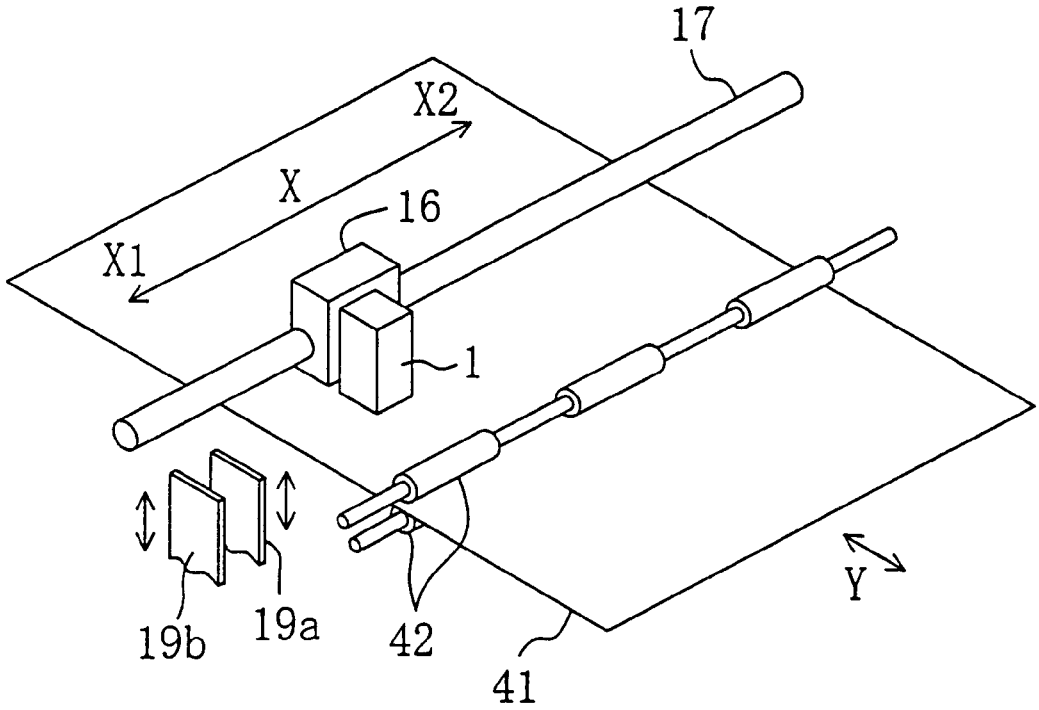
FIG. 13 is a corresponding diagram to FIG. 1 showing an arrangement in which first and second blades are provided.

Further, as shown in FIG. 12, a first nozzle plate 6*a* as a fist nozzle formation member and a second nozzle plate 6*b* as a second nozzle formation member are provided on the bottom of the ink jet head 1 with a slight clearance therebetween, wherein preferably the first nozzles 2*i* are formed in the first nozzle plate 6*a* and the second nozzles 2*j* are formed in the second nozzle plate 6*b*. As a result of such arrangement, pigment ink liable to cause clogging does not easily adhere to the surface of the second nozzle plate 6*b*, therefore controlling clogging of the second nozzles 2*j* of small diameter by pigment ink. In this case, for example, as shown in FIG. 13, it is desired that a first blade 19*a* for wiping off pigment ink adhered to the bottom of the first nozzle plate 6*a* and a second blade 19*b* for wiping off dye ink adhered to the bottom of the second nozzle plate 6*b* be provided. In other words, with only the first blade 19*a* moved upward, the ink jet head 1 is so moved as to overlie the first blade 19*a* to wipe off pigment ink adhered to the bottom of the first nozzle plate 6*a*. Thereafter, with only the second blade 19*b* moved upward, dye ink adhered to the bottom of the second nozzle plate 6*b* is wiped off in the same way as above. Such arrangement definitely ensures that clogging of the second nozzles 2*j* by pigment ink can be controlled.

Further, in the foregoing embodiment, pigment ink droplets and dye ink droplets are ejected at different ejection amounts. Alternatively, an arrangement may be made in which both pigment ink droplets and dye ink droplets are ejected at the same ejection amount (that is to say, the first and second drive pulses P1 and P2 have the same waveform and, in addition, the first and second nozzles 2*i* and 2*j* have the same diameter) and the density of dye ink droplets that are ejected from the second nozzles 2*j* onto the recording paper sheet 41 is set lower than the density of pigment ink droplets that are ejected from the first nozzles 2*i* onto the recording paper sheet 41. As a result of such arrangement, when the recording paper sheet 41 is a sheet of special paper, low- and high-density dots can be freely obtained by laying a plurality of ink droplets one on top of the other to effect recording. This achieves high image-quality recording. On the other hand, when the recording paper sheet 41 is a sheet of plain paper, there is no need for superimposition of a plurality of ink droplets, therefore allowing high-speed recording. The same operational effects as the foregoing embodiment can be obtained. Here, the density of pigment ink droplets and that of dye ink droplets are optical densities (OD values) obtained by measuring, with a reflecting densitometer (Macbeth TR-927 manufactured by Macbeth), portions on which each ink droplet, ejected onto a sheet of special paper (EPSON Super Fine Paper (tradename) by Epson Hanbai Corporation), was adhered. Preferably, the OD value of pigment ink droplets is 1.3 or greater and the OD value of dye ink droplets is 0.7 or less when recording (solid recording) is performed on each pixel whose recording pixel density is 600 dpi×600 dpi at an ink droplet amount of 16 pl (more preferably, the OD value of dye ink droplets is about ¼ of that of pigment ink droplets). Moreover, the ejection amounts of both the pigment and dye ink droplets are not necessarily the same as long as they differ from each other in their density.

Figure 14:
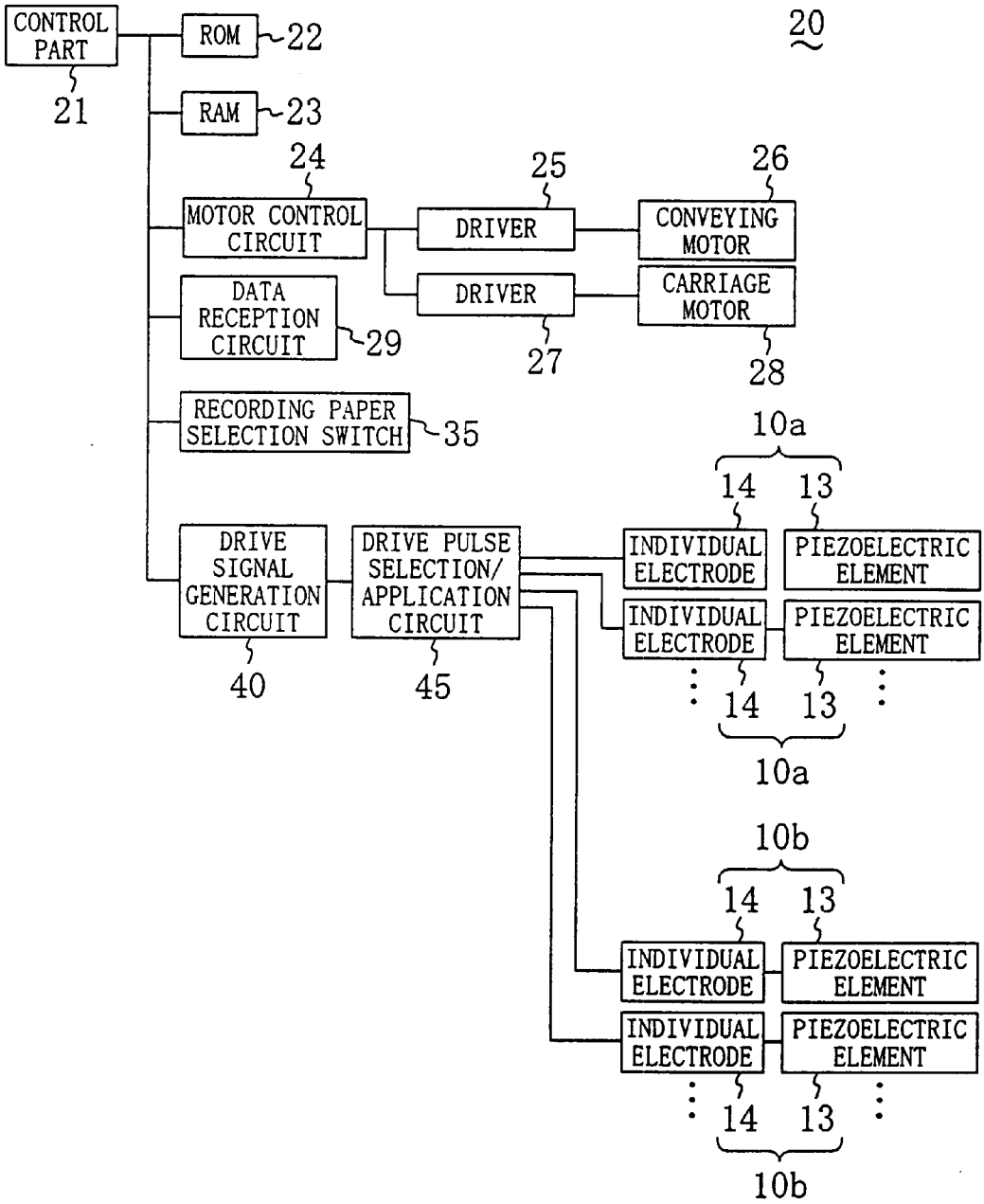
FIG. 14 is a corresponding diagram to FIG. 7 showing a variation of the drive device.
Figure 15:
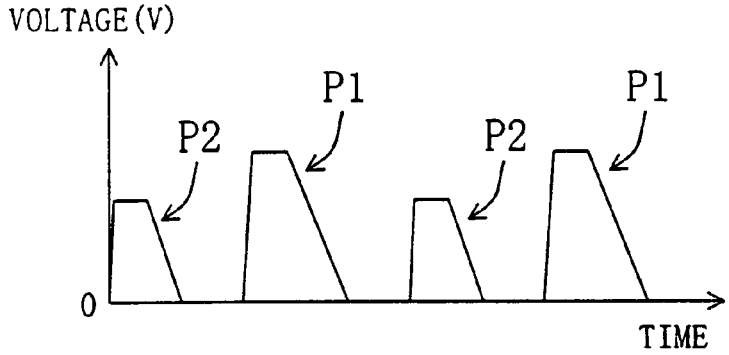
FIG. 15 is a waveform diagram depicting an example of a drive signal.

In the foregoing embodiment, the drive device 20 is provided with the first and second drive pulse generation circuits 30 and 32 so that the first and second drive pulses P1 and P2 are generated independently. Alternatively, the drive device 20 may be constructed as follows. That is, in place of the first and second drive pulse generation circuits 30 and 32 and the first and second switch circuits 31 and 33, the drive device 20 has a drive signal generation circuit 40 (drive signal generating means) for generating drive signals in which the first and second drive pulses P1 and P2 repeatedly occur and a drive pulse selection/application circuit 45 (drive pulse selection/application means) for selecting between the first drive pulse P1 and the second drive pulse P2 from a drive signal generated by the drive signal generation circuit 40 wherein when the first drive pulse P1 is selected, such a selection is applied to the first actuator 10*a* and when the second drive pulse P2 is selected, such a selection is applied to the second actuator 10*b* (see FIG. 14).

To sum up, the drive signal generation circuit 40 is so configured as to generate a drive signal with alternate occurrence of the first drive pulse P1 and the second drive pulse P2 every one pulse and such a drive signal is fed to the drive pulse selection/application circuit 45. The drive pulse selection/application circuit 45 has a switch circuit similar to the first and second switch circuits 31 and 33. When causing ejection of a pigment ink droplet from the first nozzle 2*i*, the drive pulse selection/application circuit 45 places the switch circuit in the ON state at the timing the first drive pulse P1 occurs and provides the first drive pulse P1 to the first piezoelectric actuator 10*a*, and the switch circuit is placed in the OFF state at the timing the second drive pulse P2 occurs. On the other hand, when causing ejection of a dye ink droplet from the second nozzle 2*j*, the drive pulse selection/application circuit 45 places the switch circuit in the ON state at the timing the second drive pulse P2 occurs and provides the second drive pulse P2 to the second piezoelectric actuator 10*b*, and the switch circuit is placed in the OFF state at the timing the first drive pulse P1 occurs.

In accordance with such arrangement, there is no need for individually generating the first drive pulse P1 and the second drive pulse P2, thereby making it possible to cut down the cost of drive circuits for the first and second actuators 10*a* and 10*b*. Particularly, when both pigment ink droplets and dye ink droplets are ejected for performing recording for one scan, this generally requires the first and second drive pulse generation circuits 30 and 32 as in the foregoing embodiment. However, only the drive signal generation circuit 40 is required here, so that the effect of reducing costs can be further demonstrated. In other words, by selecting, in alternating manner, between a first drive pulse P1 and a second drive pulse P2 from a drive signal generated by the drive signal generation circuit 40, it becomes possible to alternately eject a pigment ink droplet and a dye ink droplet. The ejection interval (drive frequency) at the time of ejecting only, for example, dye ink droplets, is considered to become longer in comparison with when the first and second drive pulse generation circuits 30 and 32 are provided; however, after ejection of a dye ink droplet, ejection of the next dye ink droplet is kept waiting until the residual oscillation of ink menisci in the end of the second nozzle 2*j* comes to a stop. Because of this, it is impossible to increase the drive frequency as expected even if the first and second drive pulse generation circuits 30 and 32 are provided. Therefore, it is possible to perform ejection control of pigment ink droplets and dye ink droplets by the single drive signal generation circuit 40 with little or no drive frequency drop.

Figure 16:
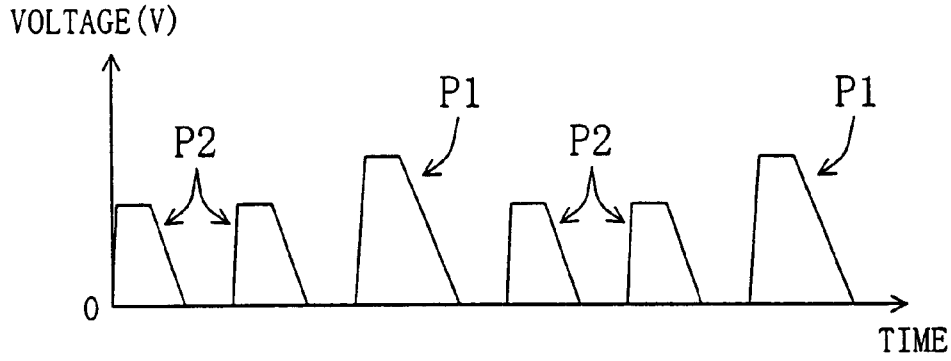
FIG. 16 is a corresponding diagram to FIG. 15 depicting a variation of the drive signal.

Further, as shown in FIG. 16, preferably the drive signal generation circuit 40 is so constructed as to generate a drive signal which repeats a pulse occurrence operation in which, after a succession of occurrences of a plurality of the second drive pulses P2 (the number is two in FIG. 16), a less number of the first drive pulses P1 (the number is one in FIG. 16) than the number of the successively-occurred second drive pulses P2 occur. This arrangement, since recording by dye ink droplets generally requires a higher recording pixel density than recording by pigment ink droplets, makes it possible to set, based on such a recording pixel density difference, the numbers of the first and second drive pulses P1 and P2 for generation of optimum drive signals (in accordance with the drive signal of FIG. 16 a recording pixel density of, for example, 300 dpi is achieved when effecting recording by pigment ink droplets and a recording pixel density of, for example, 600 dpi is achieved when effecting recording by dye ink droplets).

Figure 17:
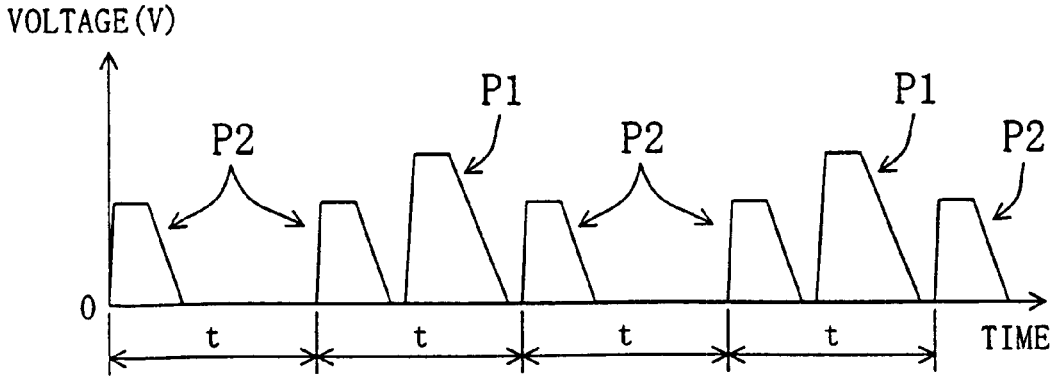
FIG. 17 is a corresponding diagram to FIG. 15 depicting another variation of the drive signal.

Further, when generating a drive signal which repeats a pulse occurrence operation in which, after a succession of occurrences of a plurality of the second drive pulses P2, a less number of the first drive pulses P1 than the number of the successively-occurred first drive pulses P2 occur, the occurrence interval of the second drive pulses P2, t, is preferably constant, as shown in FIG. 17. Because of this, dye ink droplets fired from the second nozzles 2*j* land on the recording paper to be spaced at equal intervals, thereby coping with high image-quality.

The above-described construction, in which a drive signal is generated and either the first drive pulse P1 or the second drive pulse P2 is selected from the generated drive signal, is applicable to cases where the density of dye ink droplets that are ejected from the second nozzles 2*j* onto the recording paper sheet 41 is set lower than that of pigment ink droplets that are ejected from the first nozzles 2*i* onto the recording paper sheet 41.

What is claimed is:

1. An ink jet recording device comprising an ink jet head having a first nozzle for ejection of droplets of pigment ink containing a pigment as a coloring agent and a second nozzle for ejection of droplets of dye ink containing a dye as a coloring agent so that recording is effected by ejection of ink droplets from at least either the first or second nozzle of the ink jet head onto recording paper, wherein the maximum amount of ejection of a droplet of the dye ink that is ejected from the second nozzle is set lower than the maximum amount of ejection of a droplet of the pigment ink that is ejected from the first nozzle, wherein the ink jet head further has a first actuator for causing, when a first drive pulse is applied thereto, ejection of a droplet of the pigment ink from the first nozzle and a second actuator for causing, when a second drive pulse is applied thereto, ejection of a droplet of the dye ink from the second nozzle; and wherein the ink jet recording device further comprises:

drive signal generation means for generating a drive signal in which the first and second drive pulses repeatedly occur; and drive pulse selection/application means for selecting between the first drive pulse and the second drive pulse from the drive signal generated by the drive signal generation means so that, when the first drive pulse is selected, the selection is applied to the first actuator, while, when the second drive pulse is selected, the selection is applied to the second actuator; and wherein the drive signal generation means generates a drive signal which repeats a pulse occurrence operation in which, after a succession of occurrences of a plurality of second drive pulses, a less number of first drive pulses than the number of the successively-occurred second drive pulses occur.

2. An ink jet recording device comprising an ink jet head having a first nozzle for ejection of droplets of pigment ink containing a pigment as a coloring agent and a second nozzle for ejection of droplets of dye ink containing a dye as a coloring agent so that recording is effected by ejection of ink droplets from at least either the first or second nozzle of the ink jet head onto recording paper, wherein the maximum amount of ejection of a droplet of the dye ink that is ejected from the second nozzle is set lower than the maximum amount of ejection of a droplet of the pigment ink that is ejected from the first nozzle, wherein the ink jet head further has a first actuator for causing, when a first drive pulse is applied thereto, ejection of a droplet of the pigment ink from the first nozzle and a second actuator for causing, when a second drive pulse is applied thereto, ejection of a droplet of the dye ink from the second nozzle; and wherein the ink jet recording device further comprises;

drive signal generation means for generating a drive signal in which the first and second drive pulses repeatedly occur; and drive pulse selection/application means for selecting between the first drive pulse and the second drive pulse from the drive signal generated by the drive signal generation means so that, when the first drive pulse is selected, the selection is applied to the first actuator, while, when the second drive pulse is selected, the selection is applied to the second actuator, wherein the drive signal generation means is so constructed as to generate a drive signal which repeats a pulse occurrence operation in which, after a succession of occurrences of a plurality of second drive pulses, a less number of first drive pulses than the number of the successively-occurred second drive pulses occur; and wherein the drive signal generation means is so constructed as to generate a drive signal in which a second drive pulse occurs at fixed intervals.

* * * * *